US006763749B2

(12) United States Patent
Droste et al.

(10) Patent No.: US 6,763,749 B2
(45) Date of Patent: Jul. 20, 2004

(54) WEB SPEED METERING APPARATUS AND METHOD

(75) Inventors: John F. Droste, Blue Ash, OH (US); Joseph A. Eckstein, Sunman, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 215 days.

(21) Appl. No.: 10/047,738

(22) Filed: Jan. 15, 2002

(65) Prior Publication Data

US 2003/0132263 A1 Jul. 17, 2003

(51) Int. Cl.[7] ..... B26D 7/18

(52) U.S. Cl. ..... 83/37; 83/469; 83/658; 156/164; 156/265; 226/155

(58) Field of Search ..... 83/110, 155, 37, 83/202, 469, 658; 226/95, 155, 120, 122, 137, 143, 165, 158, 10, 118.2; 156/164, 265; 242/75

(56) References Cited

U.S. PATENT DOCUMENTS

| | | | | | |
|---|---|---|---|---|---|
| 2,614,456 | A | * | 10/1952 | Zuethen | 226/58 |
| 3,044,677 | A | * | 7/1962 | Miller | 226/117 |
| 3,531,035 | A | | 9/1970 | Maynard et al. | |
| 3,549,097 | A | | 12/1970 | Seigh | |
| 3,618,722 | A | | 11/1971 | Eschenbach et al. | |
| 4,077,306 | A | * | 3/1978 | Wech | 493/35 |
| 4,249,688 | A | * | 2/1981 | Klemm | 226/24 |
| 4,464,217 | A | * | 8/1984 | Dickover et al. | 156/164 |
| 4,829,645 | A | * | 5/1989 | Kannwischer | 492/18 |
| 5,232,141 | A | * | 8/1993 | Mittmeyer et al. | 226/95 |
| 5,407,513 | A | | 4/1995 | Hayden et al. | |
| 5,693,165 | A | | 12/1997 | Schmitz | |
| 5,746,869 | A | * | 5/1998 | Hayden et al. | 156/265 |
| 5,759,340 | A | | 6/1998 | Boothe et al. | |
| 6,059,710 | A | | 5/2000 | Rajala et al. | |
| 6,074,333 | A | | 6/2000 | Rajala et al. | |
| 6,165,306 | A | | 12/2000 | Rajala | |
| 6,349,867 | B1 | * | 2/2002 | Fernfors | 226/113 |

FOREIGN PATENT DOCUMENTS

| | | |
|---|---|---|
| FR | 964184 A | 5/1949 |
| WO | WO 95/10472 | 4/1995 |

* cited by examiner

*Primary Examiner*—Allan N. Shoap
*Assistant Examiner*—Phong Nguyen
(74) *Attorney, Agent, or Firm*—Jack L. Oney, Jr.; Michael S. Kolodesh; Jay A. Krebs

(57) ABSTRACT

A web speed metering device to which a moving web is fed at a constant web infeed speed and from which the web periodically exits at a different speed that is correlated with the timing of a downstream operation performed on the moving web. The metering device is a rotatable member that is non-axisymmetric and that has a cross-sectional shape having a centroid that is offset from the axis of rotation of the rotatable member to change the web output speed as the web exits from the metering device. The metering device allows a web to be fed to a downstream cutting device and enables the web output speed to be regulated so that the web as it leaves the metering device can be cut transversely by a non-instantaneous cut that takes place over a predetermined machine-direction distance, such as a chevron-shaped cut.

22 Claims, 16 Drawing Sheets

WEB SPEED METERING APPARATUS AND METHOD

BACKGROUND OF THE INVENTION

1. Field of the Invention

The present invention relates to web handing apparatus and to a method for web handling. More particularly, the present invention relates to web handling apparatus and a web handling method wherein the speed of movement of a downstream portion of a moving web of material is varied while the upstream portion of the web that approaches the web handling apparatus is maintained at a constant web speed.

2. Description of the Related Art

It is often desirable in various manufacturing operations to control the speed of a moving web of material to temporarily change the speed of the web in response to a particular operating condition, or to enable the performance on the web of a particular operation. In that regard, the web speed can be changed in a number of ways, including varying the speeds of intermediate feed rolls that guide the web along, sometimes with web storage apparatus such as dancer rolls, shuttle devices that reciprocate to temporarily shift the web, or the like. Alternatively, the speed of a moving web can be changed by varying the speed of a drive motor that drives an unwind stand or a web take-up roll that causes web movement through the web handling apparatus.

Although web-speed-change devices are known, the use of such known devices often involves web speed changes that are achieved by periodically accelerating and decelerating various of the rotating elements of the web feed system. As a result, varying cyclic loads are imposed on the respective rotating elements of the web feed apparatus, and those varying loads cause varying levels of cyclic stress on those elements. The varying stress levels, which also are influenced by the magnitude of the output and speed of the drive motor, can, over time, lead to the need for more frequent maintenance and replacement of parts because of increased wear that occurs as a result of the changing stress levels. Additionally, to periodically accelerate rotating elements to effect web speed changes requires a larger size, more costly drive motor that provides a higher output power than would be required if the rotational speeds of the rotating elements were maintained substantially constant.

Accordingly, it is desirable to provide apparatus that allows the speed of a web to be controlled to a desired value at a particular point in a manufacturing process, either greater than or less than the speed of the incoming web, while maintaining the incoming web speed at a constant value. Consequently, rotational speed changes within the web feed mechanism are desirably avoided, to minimize the stresses on and the resulting wear of the rotating elements of the apparatus, and to reduce the need for frequent servicing and repair of rotating elements of the apparatus.

It is also desirable to eliminate the need for reciprocating web-take-up devices, such as dancer rolls and shuttles that are sometimes employed in web feed devices to allow changes of web output speed while maintaining the web input speed substantially constant. An example of one such reciprocating, shuttle-type device is disclosed in U.S. Pat. No. 5,693,165, entitled "Method and Apparatus for Manufacturing an Absorbent Article," which was issued on Dec. 2, 1997, to Christoph Schmitz.

Another proposal for periodically changing the speed of a web while the web infeed speed is maintained constant is disclosed in U.S. Pat. No. 5,407,513, entitled "Apparatus and Process for Cyclically Accelerating and Decelerating a Strip of Material," which issued on Apr. 18, 1995, to Michael P. Hayden et al. The apparatus disclosed in that patent includes an eccentric accelerator in the form of a spindle that is carried on a rotating drive shaft and that is offset from the axis of rotation of the drive shaft. Accordingly, as the drive shaft rotates the periphery of the spindle describes a circle that is concentric with the axis of the drive shaft. The apparatus disclosed in that patent is utilized in the context of apparatus for changing the speed of a web of a fastener material that is to be applied at spaced intervals to a second moving web. Because of the spacing of the fasteners that are cut from the web of fastener material, the incoming speed of the fastener material is maintained constant while the web passes over the eccentric accelerator to periodically accelerate and decelerate the web of fastener material to enable a cut to be made so that the cut portions are properly positioned relative to a base sheet with which the cut portions are associated. However, in that apparatus the cut that is made in the web is a transverse cut that extends perpendicularly to the web movement direction, and the eccentric accelerator causes the fastener web to only instantaneously match its speed with that of a cutter and anvil roll combination that effects the transverse cuts in the fastener material. As a result, the Hayden et al. device does not permit cuts to be made that are at an angle with the web movement direction and that take place over a given period of time, as opposed to instantaneously.

An object of the present invention to provide a method and an apparatus that allows a constant web infeed speed with varying web output speeds, and that will enable an angular cut to be made in the web material by matching the web speed to the surface speed of a downstream operation for a predetermined time period.

It is another object of the present invention to provide a web feed system for changing a web output speed while maintaining web input speed constant and while maintaining at a substantially constant value the rotational speeds of the rotating elements of the system.

SUMMARY OF THE INVENTION

In accordance with one aspect of the present invention, a web speed metering apparatus is provided for receiving and engaging a web that is supplied to the metering apparatus at a constant in-feed speed. The output speed of the web leaving the metering apparatus is cyclically varied. The apparatus includes a rotatable shaft that defines an axis of rotation and that is disposed across a path of movement of a web of material to be metered. An elongated, web-engaging surfaces is carried on the shaft and extends axially thereof to define a surface having a constant cross-sectional configuration in a direction perpendicular to the axis of rotation. The web-engaging surface is adapted to receive an incoming web that travels at a constant in-feed speed and defines a non-circular cross-section in a direction perpendicular to the axis of rotation. The cross-section has a centroid that is offset from the axis of rotation to cause the output speed of the web as the web leaves the web-engaging surface to vary as a function of the instantaneous radial spacing of the web from the axis of rotation of the web-engaging surface.

In accordance with a further aspect of the present invention, a method is provided for varying the output speed of a first moving web having a constant input speed and a timed relationship with a web processing station for a continuously moving second web that is supplied at a constant in-feed speed. The method includes the steps of feeding the first moving web at a first constant speed to a web deflection station for a predetermined first time period to allow an operation to be performed on the web downstream of the deflection station. An intermediate portion of the moving web is deflected so that the speed of the leading edge of web is decreased for a predetermined second time period to a speed less than that of the first constant speed to allow a predetermined leading edge advancement length. Deflection of the moving web is terminated and the leading edge of the web is fed at the first constant speed for the predetermined first time period. The leading edge of the moving web is advanced at predetermined distance and is fed at the first constant speed for the predetermined first time period.

DESCRIPTION OF THE PREFERRED EMBODIMENTS

Figure 1:
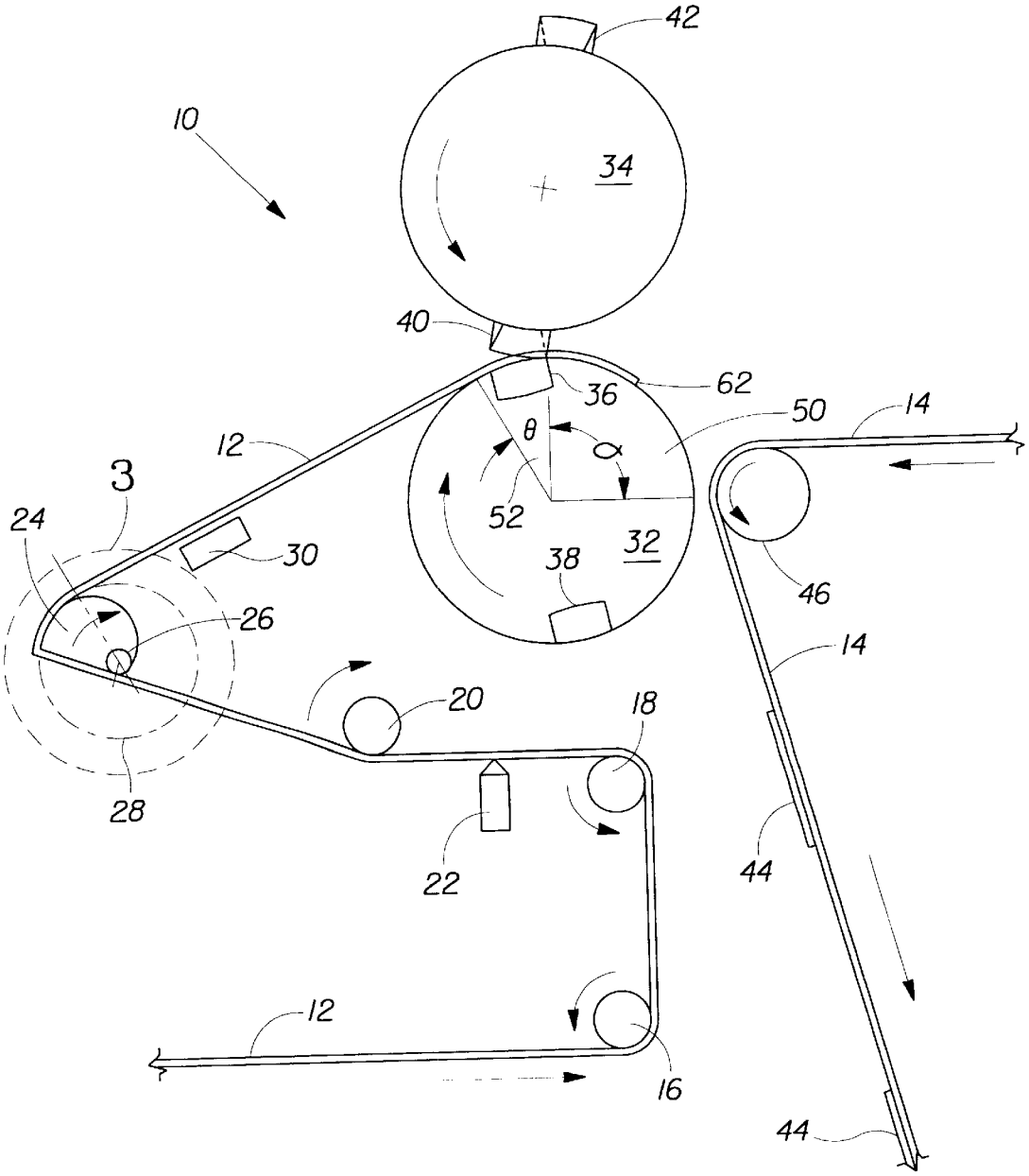
FIG. 1 is a schematic, side elevational view of an apparatus that includes a web speed metering apparatus in accordance with the present invention in association with web cutting and web feeding apparatus.

Referring now to the drawings, and particularly to FIG. 1 thereof, there is shown cutting and joining apparatus 10 for cutting sections of predetermined shape and length from a first continuously moving web 12 and for associating the sections cut from the first moving web with a second moving web 14. The illustrated arrangement will be described in the context of an angular cut across the first web, such as to cut a chevron-shaped section from the first continuously moving web, and associating successive sections cut from the first web in spaced relationship relative to each other and successively along the machine direction of a second continuously moving web. The first and second webs each move at a constant speed, but the second web moves at a faster speed than that of the first web. The second web can serve as a carrier web that carries a series of spaced elements with which the sections cut from the first web are to be associated.

The illustrated apparatus can advantageously be utilized in the manufacture of disposable diapers. For example, chevron-shaped fastener components can be cut from the first moving web when it is a fastener component material, and the cut components can be transferred in spaced relationship, relative to each other, to a second moving web that is a liquid-impervious backsheet material. However, although disclosed in the context of disposable diaper manufacture, it will be appreciated by those skilled in the art that the arrangement shown, as well as individual elements thereof, can be utilized in connection with many other different types of products in which pieces cut from one moving web are to be associated in some way with another moving element or another moving web.

First moving web 12, which travels at a first constant speed and which can be in the form of an overlay material, is fed to the cutting and joining apparatus 10 from a web supply source (not shown), such as an unwind stand. Web 12 passes over a pair of spaced, parallel first and second idler rolls 16, 18 to a third idler roll 20. Between second and third idler rolls 18, 20 there is shown a glue applicator 22 that can optionally be provided in order to apply a layer of glue, or, alternatively, a predetermined glue pattern, to the adjacent surface of web 12. After passing over third idler roll 20, web 12 engages and passes over the outer surface of a web deflector 24.

Web deflector 24 is carried on a rotatable shaft 26, and it has a cross-sectional area the centroid of which is offset from the axis of rotation of shaft 26. The dashed circle 28 surrounding the axis of shaft 26 describes the circular pathway swept by the radially-outermost surface of web deflector 24.

After passing over a portion of the outer surface of web deflector 24, first web 12 progresses over a guide bar 30 and then comes into contact with the outer cylindrical surface of an anvil roll 32 that is adjacent to the outer peripheral surface of a similarly-sized cutter roll 34. Anvil roll 32 has a pair of diametrically-oppositely-disposed peripheral anvils 36, 38, and cutter roll 34 has a corresponding number of diametrically-oppositely-disposed peripheral cutting knives 40, 42 that are so positioned on the periphery of cutter roll 34 as to periodically engage respective ones of anvils 36, 38 as cutter roll 34 and anvil roll 32 rotate together in the directions shown by the arrows in FIG. 1.

Guide bar 30 that is positioned between web deflector 24 and anvil roll 32 is connected with a source of pressurized air (not shown) in order to lightly lift the moving first web 12 away from the surface of guide bar 30 and to support moving web 12 without significant frictional drag as the web passes toward anvil roll 32. In that regard, guide bar 30 serves to maintain moving web 12 in a predetermined position immediately upstream of anvil roll 32 and also to provide a web guide surface to prevent relatively flexible webs from being diverted downwardly, as viewed in FIG. 1, away from the desired path of web travel, after a forward portion of the web material has been cut, as will hereinafter be described.

Cutting knives 40, 42 carried by cutter roll 34 serve to cut sections 44 of predetermined size and shape from first web 12, after which anvil roll 32 carries cut sections 44 to a nip defined between the periphery of anvil roll 32 and the periphery of a transfer roll 46 that is in contacting peripheral engagement therewith. Transfer roll 46 receives second moving web 14 from a source (not shown), such as an unwind stand, or the like. Second moving web 14 travels at a second constant speed and passes from transfer roll 46 to a downstream processing station (not shown) at which additional operations and manipulations can be performed on web 14. As shown in FIG. 1, second moving web 14 receives cut sections 44 that are pressed against second moving web 14 between anvil roll 32 and transfer roll 46, and that adhere to second moving web 14 by virtue of the glue that had been applied to the outwardly facing surface of first moving web 12 by glue applicator 22. As also apparent from FIG. 1, the several cut sections 44 are positioned on second moving web 14 in spaced relationship, at a predetermined spacing along the machine direction of second moving web 14.

Figure 2:
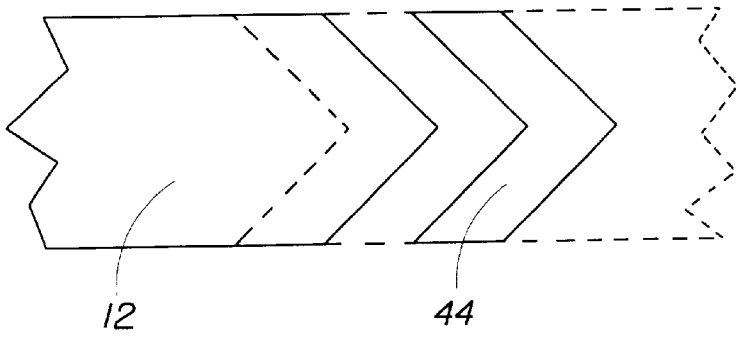
FIG. 2 is a top view of a web showing one possible form of cut to be made in the moving web utilizing apparatus in accordance with the present invention.

The illustrated arrangement is particularly adapted to enable cuts to be made in first moving web 12 that extend at an acute angle to the machine direction of that web. For example, and as shown in FIG. 2, when cutting knives 40, 42, carried by cutter roll 34, are chevron-shaped, they can provide chevron-shaped cut sections 44. Alternatively, cutting knives 40, 42 can be of bowed, curved form, or of any other form wherein the cut that is made includes a component of the cut that extends for some predetermined distance along the machine direction of the web. The cutting process occurs progressively as anvil roll 32 rotates with web 12 carried on the peripheral surface of roll 32, as opposed to an instantaneous transverse cut at a right angle to the machine direction movement of the web.

Referring once again to FIG. 1, anvil roll 32 has a plurality of peripherally-disposed apertures (not shown) that extend across and around the cylindrical outer surface of the roll. The apertures at predetermined portions of the anvil roll periphery are in communication with a source of vacuum (not shown) through a suitable vacuum manifold (not shown). The vacuum manifold can be placed in contact with an apertured end wall of anvil roll 32 to provide a communication path between the source of vacuum and the peripherally-distributed apertures. Apertured rolls having an apertured end wall and corresponding manifolds that provide pressurized air or vacuum to peripherally-distributed apertures in such a roll while it is rotating are known and will therefore not be further described herein.

Anvil roll 32 includes a holding zone 50 that extends over a predetermined peripheral area of the roll, such as the peripheral area subtended by the angle $\alpha$, which can be 90° as shown in FIG. 1. Angle $\alpha$ can be another angle than 90°, based upon the relative positions of anvil roll 32, cutter roll 34, and transfer roll 46, to maintain cut sections 44 on the peripheral surface of anvil roll 32 after the second cut that defines the machine-direction length of cut section 44, until the cut section is transferred to second web 14. Holding zone 50 can be a high vacuum zone that serves to relatively tightly hold cut sections 44 to the surface of anvil roll 32 after the sections have been severed from first moving web 12. Thus, rotating anvil roll 32 carries cut sections 44 from the nip defined between cutter roll 34 and anvil roll 32 to the nip defined between transfer roll 46 and anvil roll 32.

A web slip zone 52 is provided on anvil roll 32 immediately upstream of holding zone 50. Web slip zone 52 is defined by a predetermined peripheral area of anvil roll 32, such as the peripheral area subtended by the angle $\theta$, and provides a zone that is in communication with a source of low vacuum to lightly hold web 12 against the surface of anvil roll 32. Web slip zone 52 allows the leading edge of web 12 to slip relative to the moving peripheral surface of anvil roll 32 at a time before a cut is made in the web. The angle $\theta$ defining web slip zone 52 can be an angle of approximately 30°, although that angle can be any desired angle and can be selected based upon the relative sizes and relative dispositions of the elements of the apparatus that are upstream of anvil roll 32.

As will be more fully described hereinafter, the rotation of web deflector 24, which rotates in the same direction as anvil roll 32 and at a constant angular speed, causes the speed of web 12, as it leaves the web deflector, to undergo cyclic acceleration and deceleration, depending upon the angular position of web deflector 24 relative to anvil roll 32. In the arrangement illustrated in FIG. 1, the diameter of imaginary circle 28 described by the radially-outermost surface of web deflector 24, as the deflector is rotated about the axis of shaft 26, is equal to the radius of anvil roll 32, to enable two cuts at an appropriate spacing to be made in web 12 in order to provide a cut segment 44 having the desired machine-direction length. In that regard, the angle $\phi$ shown in FIG. 1 subtends an arc on web deflector 24 having a machine-direction length that corresponds with the machine-direction lengths of each of transversely-disposed cutting knives 40, 42 carried by cutter roll 34.

Figure 3:
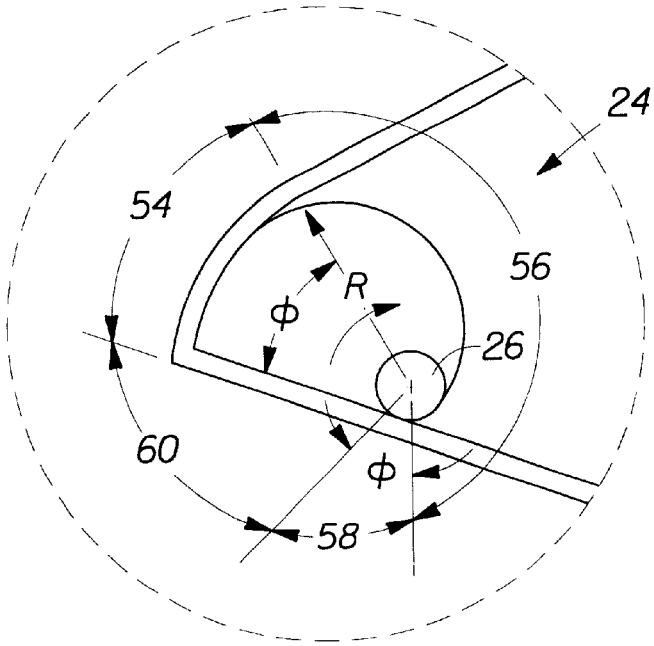
FIG. 3 is a view parallel to the machine axis illustrating the external peripheral configuration of a web deflector in accordance with one embodiment of the present invention.

The external peripheral configuration of web deflector 24 is shown in enlarged form in cross section in FIG. 3. In the configuration as shown, the upper left portion of the deflector cross section includes a first constant radius zone 54 subtended by angle $\phi$, which can range from about 2° to about 35°. The surface length of first constant radius zone 54 corresponds with the machine-direction-length component of a single cut to be made in web 12. Thus, the peripheral distance along the surface of web deflector 24 defined by first contact zone 54 corresponds with the machine direction length of the cut to be made in web 12. During the time that a cut is made in web 12, the linear speed of that portion of the web that is in contact with anvil roll 32 matches the linear speed of the periphery of the anvil roll, so that the cut can be cleanly made.

Proceeding in a clockwise direction from first constant radius zone 54, relative to the axis of rotation of the deflector, the next succeeding portion of the deflector surface is a curvilinear intermediate section that resembles a spiral or a volute and serves to define a web storage zone 56. The storage zone subtends an angle that ranges from about 30° to about 220°. Incoming web 12 is progressively deflected away from the axis of rotation of web deflector 24 and away from anvil roll 32 by web storage zone 56 until a succeeding cut is intended to be made in web 12.

After web storage zone 56, there is provided a second constant radius zone 58 on web deflector 24. Within second constant radius zone 58 the speed at which the web section is received matches the constant infeed speed of the upstream portion of web 12. The second constant radius zone subtends an arc that is the same angle $\phi$ as that of the first constant radius zone.

Proceeding clockwise from second constant radius zone 58 and terminating at first constant radius zone 54 is a rectilinear intermediate section that defines a null zone 60 that subtends an angle that can range from about 45° to about 87°. Within null zone 60 the leading edge portion of web 12 decelerates, relative to the surface of anvil roll 32, in preparation for the subsequent web storage and the ensuing next cut cycle.

Figure 4:
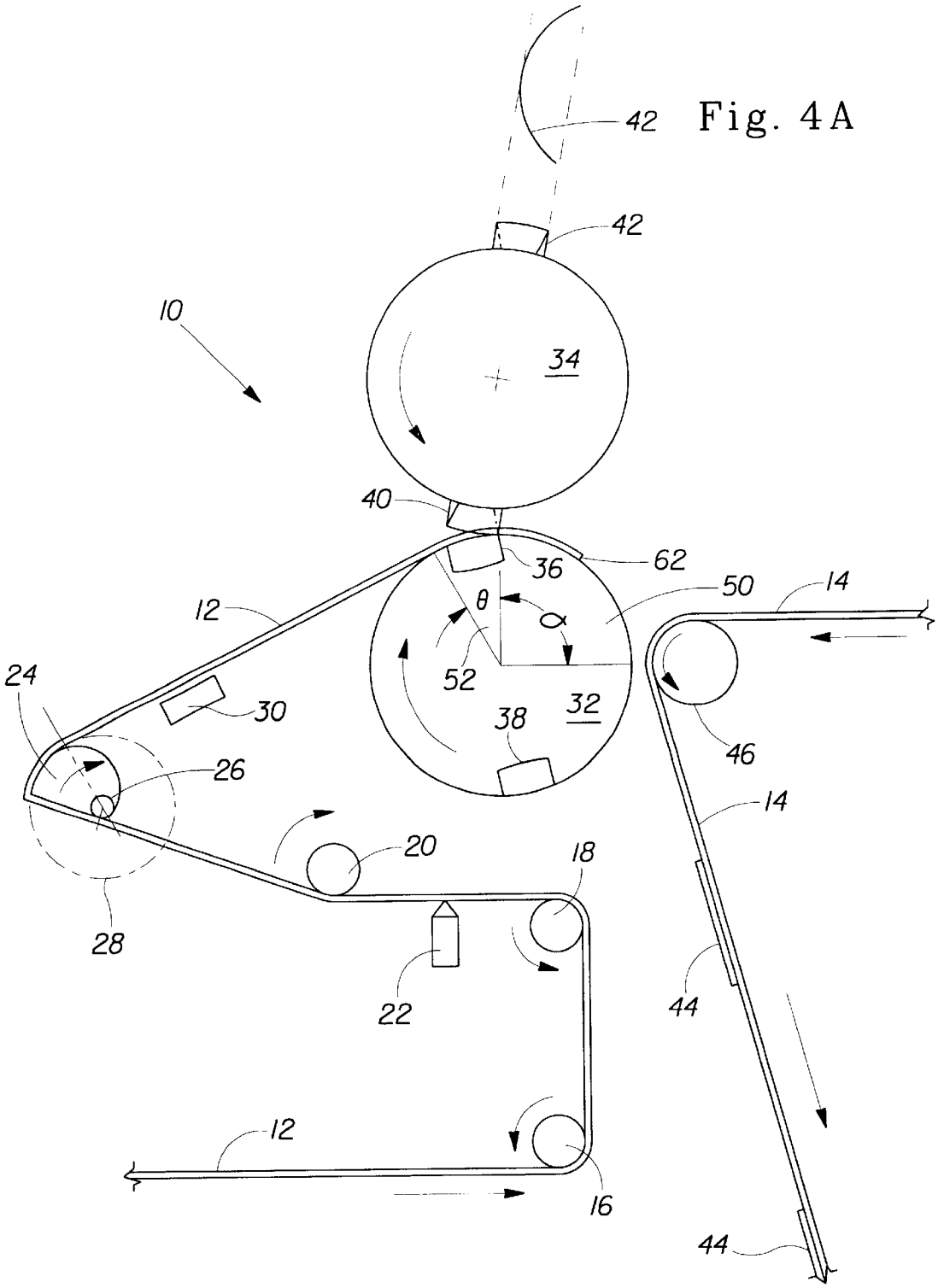
FIGS. 4 through 11 are sequential views showing the positions of the various elements of the cutting apparatus, a web deflector, and the web that is deflected during a complete operating cycle of the cutting apparatus.

The relative positions of the various elements of the apparatus shown in FIG. 1 during various portions of an operating cycle are shown progressively in FIGS. 4 through 11 for successive incremental increases in the degree of rotation of anvil roll 32, cutter roll 34, and web deflector 24. In the positions of the respective components of the apparatus as they are shown in FIG. 4, several cut sections 44 have been transferred to continuously moving second web 14. Additionally, the leading edge 62 of first web 12, which is defined by the second cut that formed the trailing edge of the immediately preceding cut section 44, has passed the twelve o'clock position on anvil roll 32 as the forward portion of first web 12 travels at the same linear speed as the surface speed of the anvil roll.

In the positions shown in FIG. 4, the cutter is just beginning the second cut into the forward portion of first web 12 to form what will be the next cut section. During that time web deflector 24 is rotating to allow the forward portion of first web 12 to proceed at a linear speed that matches the peripheral surface speed of anvil roll 32. As anvil roll 32 and cutter roll 34 continue to rotate through an angle of about 20°, web deflector 24 rotates through an angle twice that size, of about 40°, to the position shown in FIG. 5.

Figure 5:
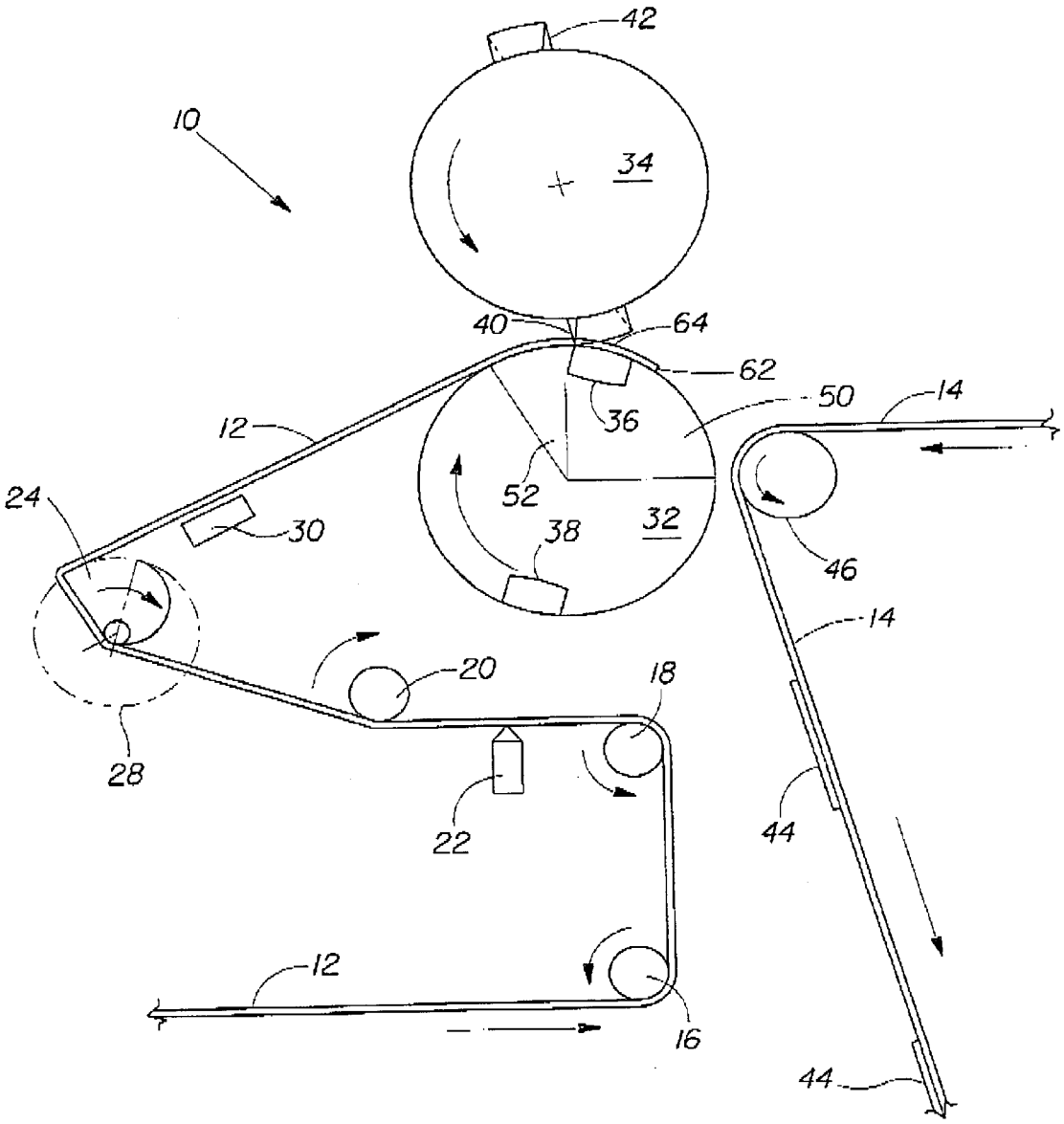

In the relative positions of the several components of the apparatus as shown in FIG. 5, the second cut has been completed in first web 12 to form the next cut section 64. The cut was effected during the time the forward portion of first web 12 moves at the same speed as the surface speed of the anvil roll. Cut section 64 is maintained on the peripheral surface of anvil roll 32 in holding zone 50 by the vacuum that is applied to an end wall of anvil roll 32. At the completion of the second cut, web deflector 24 has rotated to a point at which the matching of the linear speeds of the forward portion of first web 12 and that of the periphery of anvil roll 32 terminates.

Figure 6:
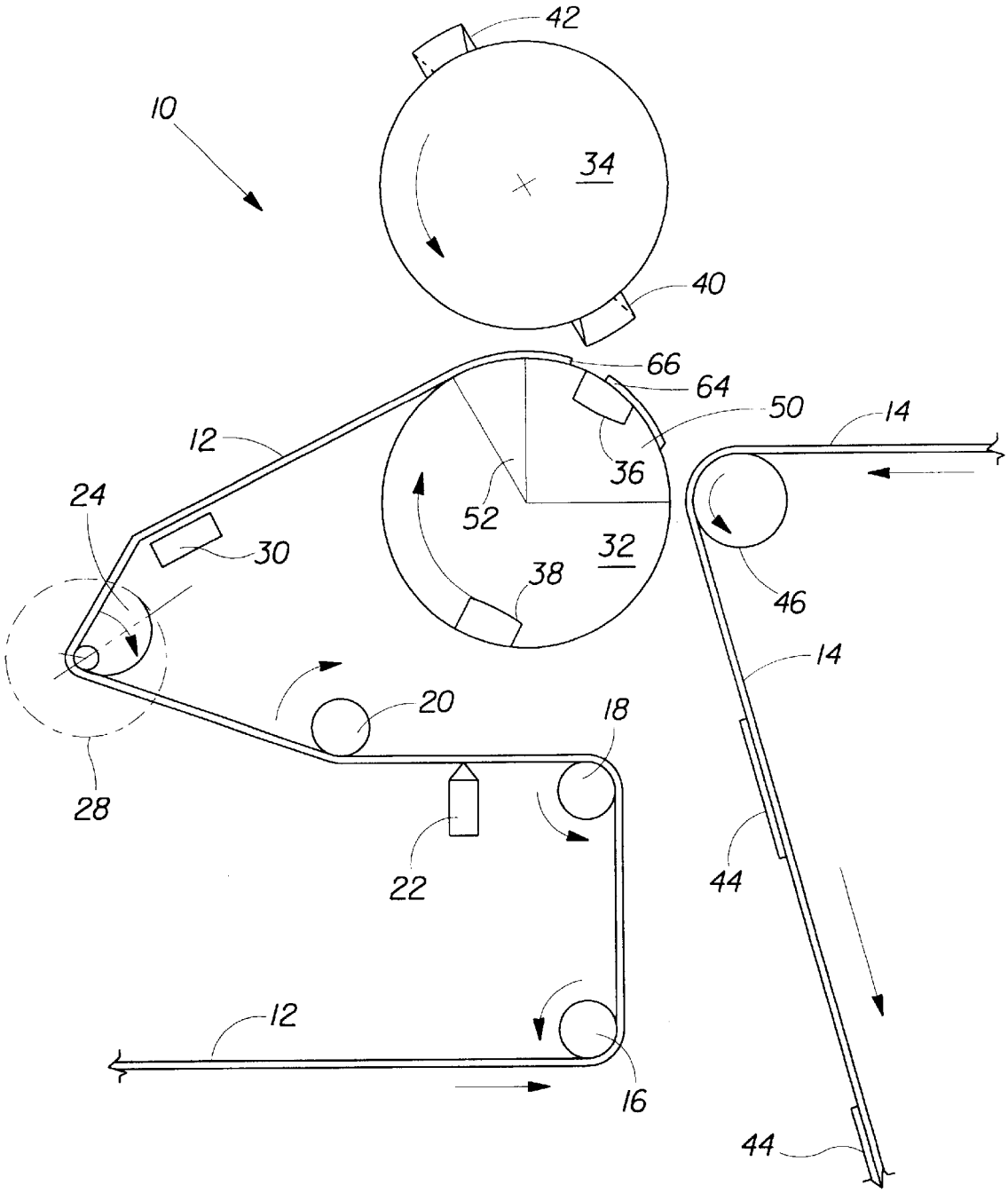

After a second cut is completed to define a complete cut section 44, anvil roll 32 and cutter roll 34 each continue to rotate to the positions shown in FIG. 6, which are approximately 25° of rotation beyond their positions as shown in FIG. 5. When the rolls are in the FIG. 6 position, cutting knife 40 has separated from associated anvil 36, and cut section 64 has been retained in holding zone 50 of anvil roll 32 as the anvil roll surface revolves toward transfer roll 46. In the meantime, web deflector 24 has continued its rotation as the leading edge of first web 12 has moved beyond the twelve o'clock position relative to anvil roll 32 by virtue of the reduced outward deflection of web 12 by web deflector 24. As also is apparent from FIG. 6, first web 12 begins to come into contact with web storage zone 56 of web deflector 24. Additional rotation of web deflector 24 serves to cause the approaching portion of first web 12 to be pushed radially outwardly, relative to web deflector 24, and in a direction away from anvil roll 32, as is shown more clearly in the progressive views of FIGS. 7 through 10.

Figure 7:
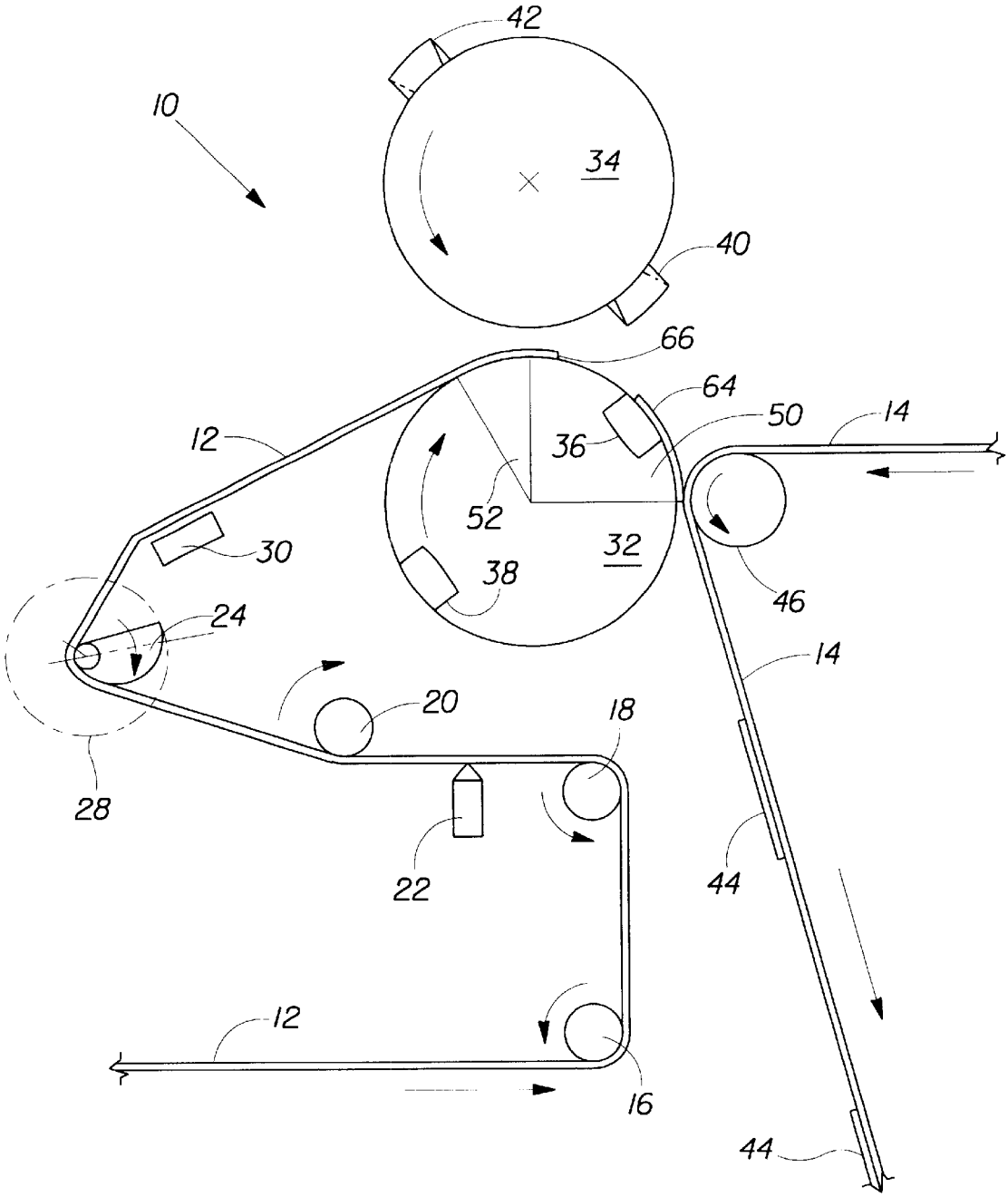
Figure 8:
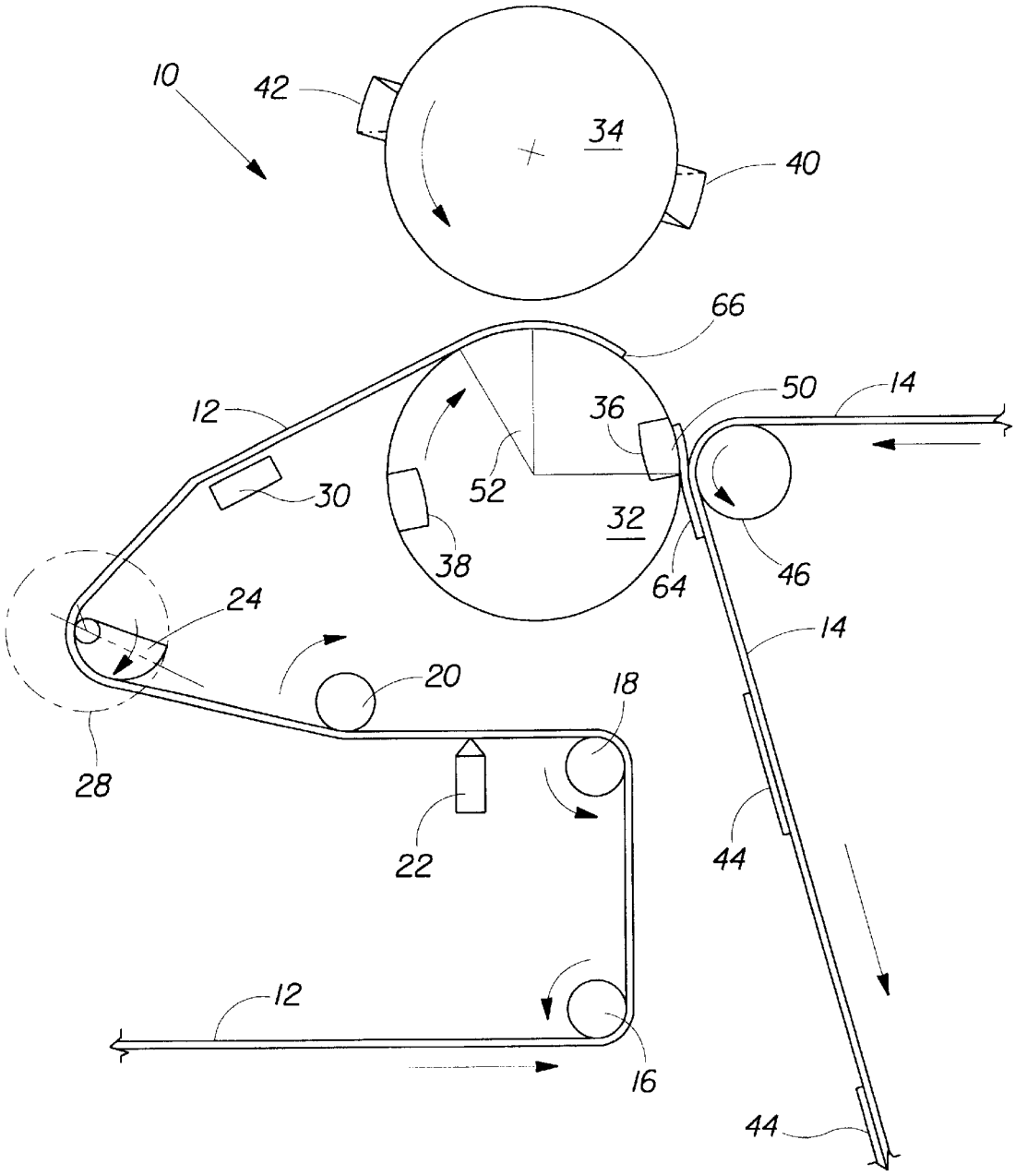

Referring now to FIGS. 7 and 8, cut segment 64 is carried by anvil roll 32 into the nip defined between anvil roll 32 and transfer roll 46, to begin the gradual transfer of cut segment 64 from anvil roll 32 to the facing surface of second web 14. During the time interval within which cut segment 64 is undergoing transfer to second web 14, the speed of the new leading edge 66 at the forward portion of first web 12 diminishes and the forward portion of first web 12 slips relative to the peripheral surface of anvil roll 32 as the anvil roll continues to rotate at a constant rotational speed. The slippage occurs because of the progressively increasing radius of web deflector 24 within web storage zone 56, which pushes the approaching portion of first web 12 in a direction away from anvil roll 32 as first web 12 continues its movement, resulting in new leading edge 66 at the forward portion of first web 12 being substantially stationary relative to the axis of rotation of anvil roll 32 as the anvil roll continues to rotate. The forward portion of first web 12 is lightly held against the moving peripheral surface of anvil roll 32 by a low vacuum level communicated to anvil roll 32 and applied at the roll surface at web slip zone 52. During that time the downstream portion of first web 12 between web deflector 24 and anvil roll 32 is maintained at a constant angle relative to anvil roll 32 by virtue of guide bar 30.

Figure 9:
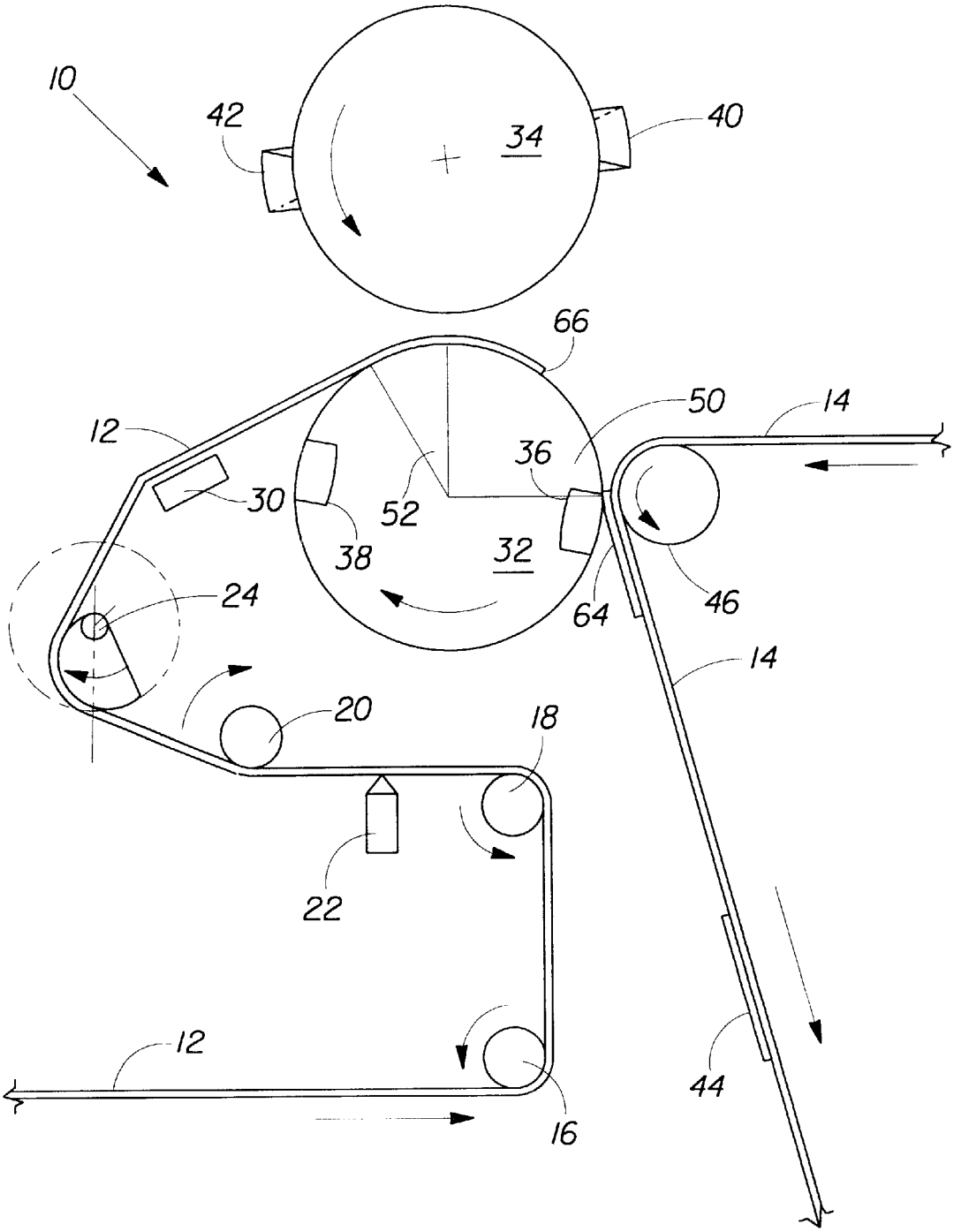
Figure 10:
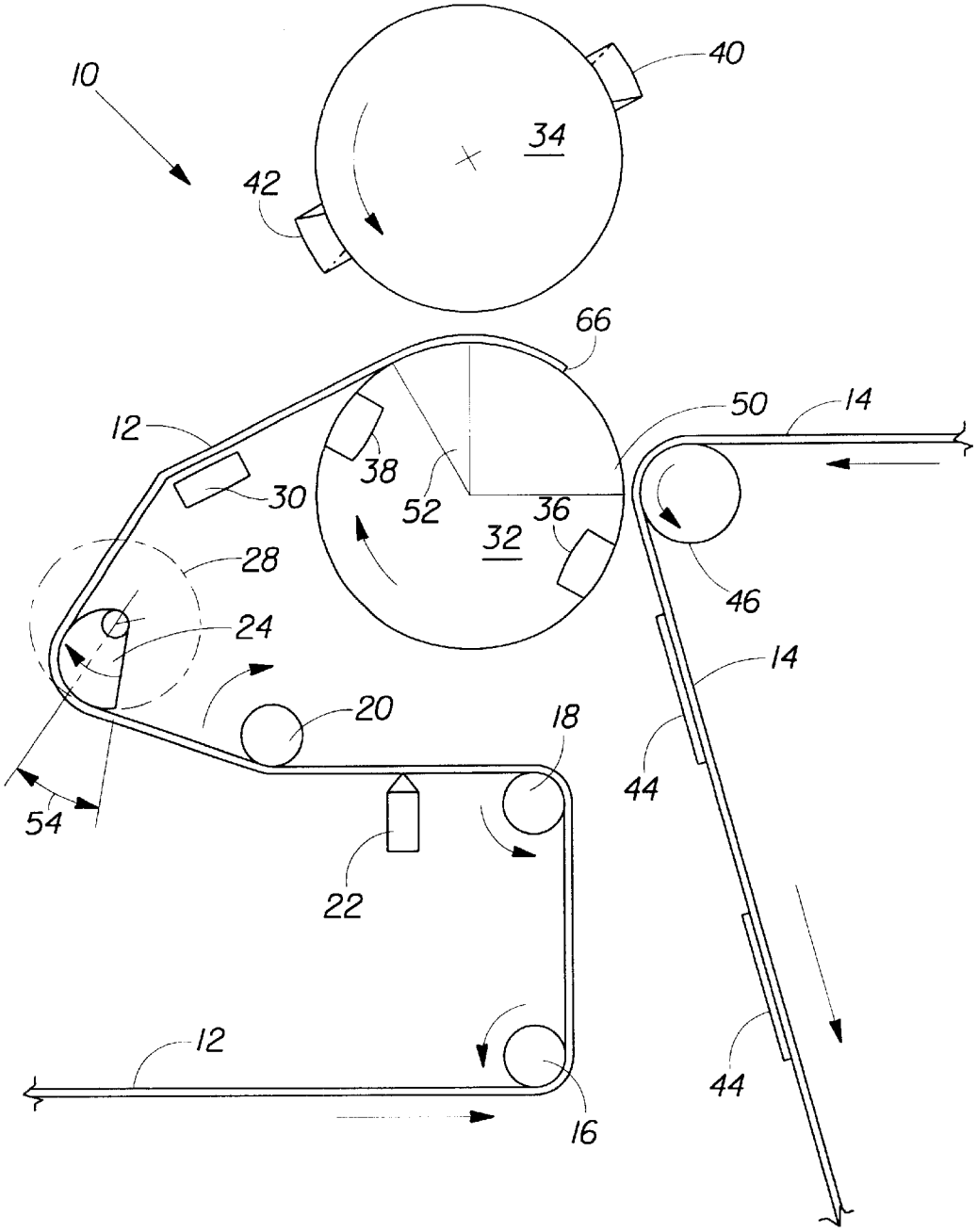

In FIG. 9 the respective components have continued their rotation and cut segment 64 has been completely transferred to second web 14. At the same time, new leading edge 66 of first web 12 continues to slip on the peripheral surface of anvil roll 32 as additional first web material is, in essence, taken up or stored by the increasing radius of web deflector 24 as it rotates around its axis to the position shown in FIG. 10. At that point the deflection of first web 12 away from anvil roll 32 has been completed, and first web 12 begins to come into contact with first constant radius zone 54 of web deflector 24.

Figure 11:
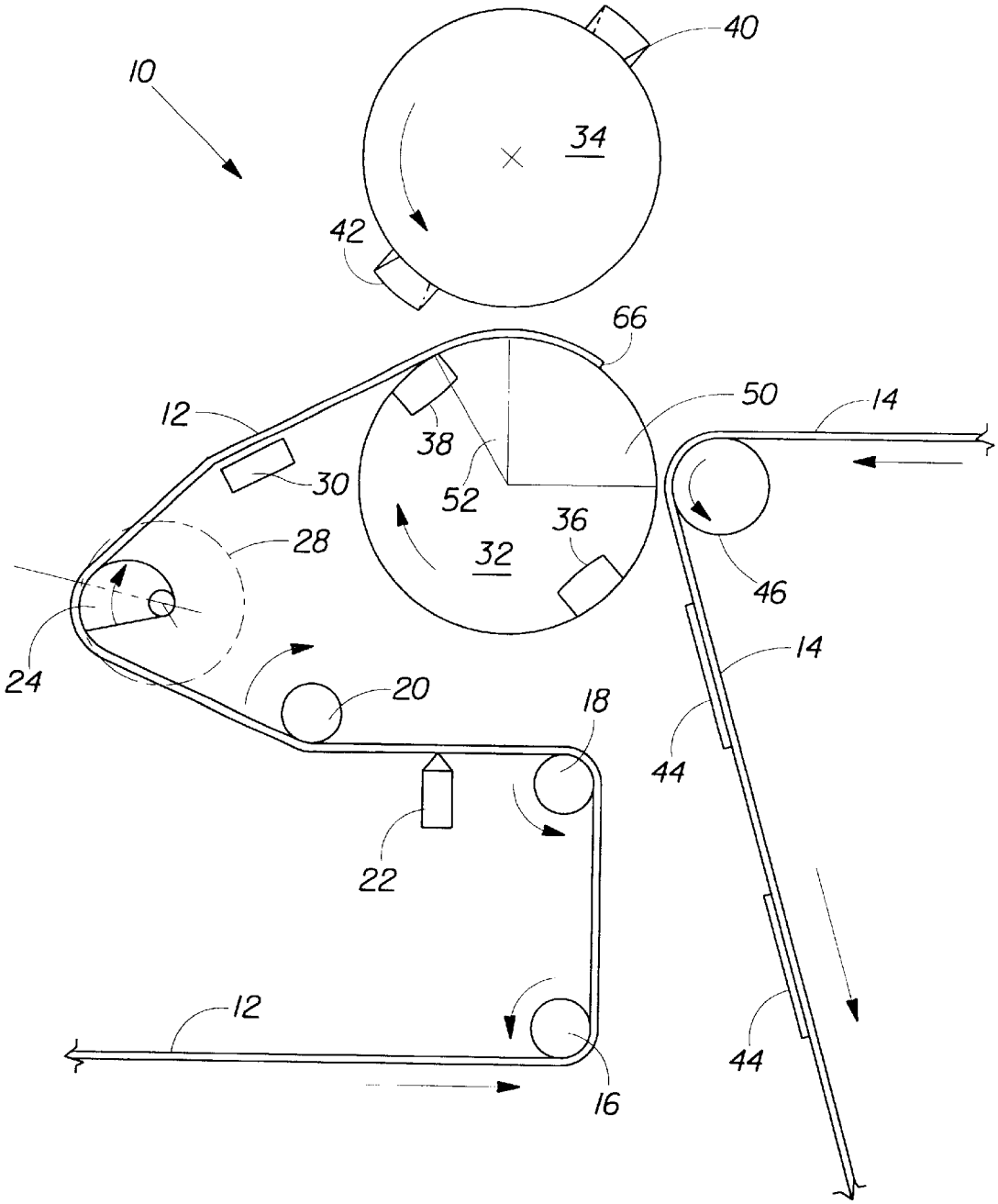

FIG. 11 shows the components after they have rotated through an additional increment. Anvil roll 32 and cutter roll 34 are shown in their respective positions shortly before a successive cut at the forward portion of first web 12 is commenced to define the next cut section. The forward portion of first web 12 continues to slip on the peripheral surface of anvil roll 32, at a gradually diminishing relative speed, as cutting knife 42 carried by cutter roll 34 approaches anvil 38 carried by anvil roll 32. New leading edge 66 of first web 12 begins to accelerate to a linear speed that matches the peripheral speed of anvil roll 32 until the components of the apparatus again reach their respective positions as shown in FIG. 4 to begin the next cutting cycle.

As will be appreciated, the disclosed apparatus permits a cut to be continuously made as the anvil roll rotates, so that the cut is made in a progressive manner, rather than instantaneously across the overlay material web, as in the prior art devices. Further, it will also be apparent that the respective rotating elements of the apparatus rotate continuously and at a constant speed, thereby avoiding the need for sudden decelerations and accelerations of the rolls, with the consequent stresses and increased wear that such operations engender. Moreover, the web deflector 24, as shown in FIGS. 1–11, having a continuous outer surface, can be particularly adapted for use of the device in connection with web materials having a relatively moderate modulus of elasticity. Such web materials should be capable of accepting the tensile loads that are applied to the first moving web during the course of the rotational movement of web deflector 24 as it deflects first web 12 away from anvil roll 32 during the web take-up portion of the operating cycle, and without significant elongation.

The web deflector in accordance with the present invention is also adaptable for use in connection with web materials that have a relatively low modulus of elasticity. For example, relatively delicate webs of material, such as tissue, certain non-woven fibrous webs or other types of extensible materials, can also be utilized in an apparatus that includes a web deflector in accordance with the present invention. When such low modulus materials are utilized as the first web material it is desirable to reduce the level of surface friction between the first web material and the web deflector, to avoid excessive elongation of the web during the web-take-up phase of the operating cycle. Thus, it is desirable to minimize the surface-friction-induced tension applied to the first web to avoid permanent elongation of the web, which could result in cut segments having different or irregular cut lengths.

Figure 12:
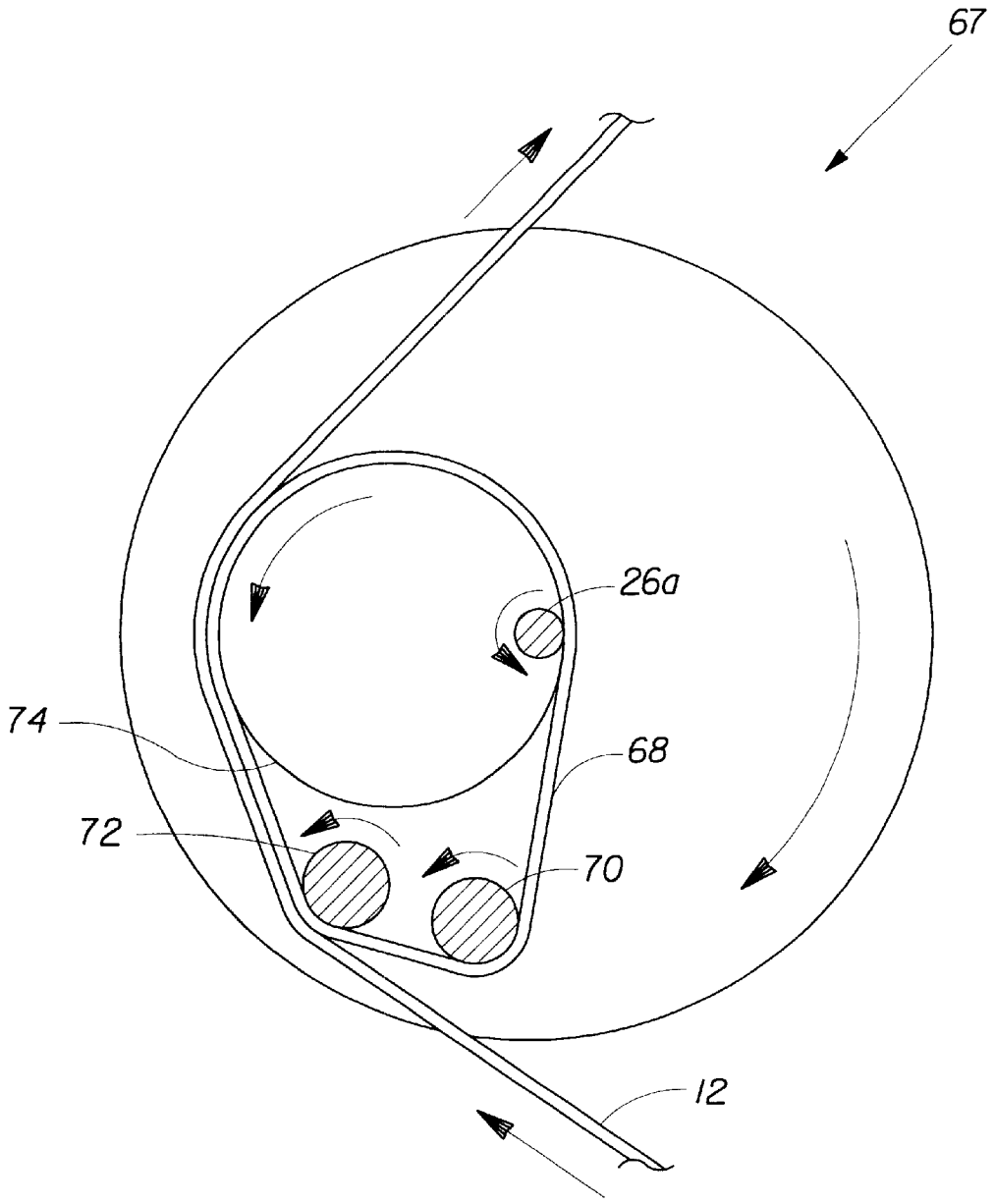
FIG. 12 is a view parallel to the machine axis illustrating the external peripheral configuration of a web deflector in accordance with another embodiment of the present invention, defined by a belt configured by a series of spaced parallel rolls.

One way in which surface friction between the web deflector and first web 12 can be minimized is by providing a web deflector 67 as shown in FIG. 12. Web deflector 67 has a peripheral surface that itself moves, and at substantially the same linear speed as that of the forwardmost portion of web 12 Such a moving web deflector surface can be provided by a driven, endless belt 68 that extends across the width of web deflector 67 and that defines the web deflector outer peripheral surface. The belt is driven to move at substantially the same linear speed as that of first web 12, and it can be supported on a plurality of elongated rollers 70 through 74. Rollers 70 through 74 can be driven by gears from drive shaft 26*a* or by a suitable belt drive system similar to that described hereinafter in connection with the roller drive system described hereinafter and shown in FIGS. 13 and 14.

Figure 13:
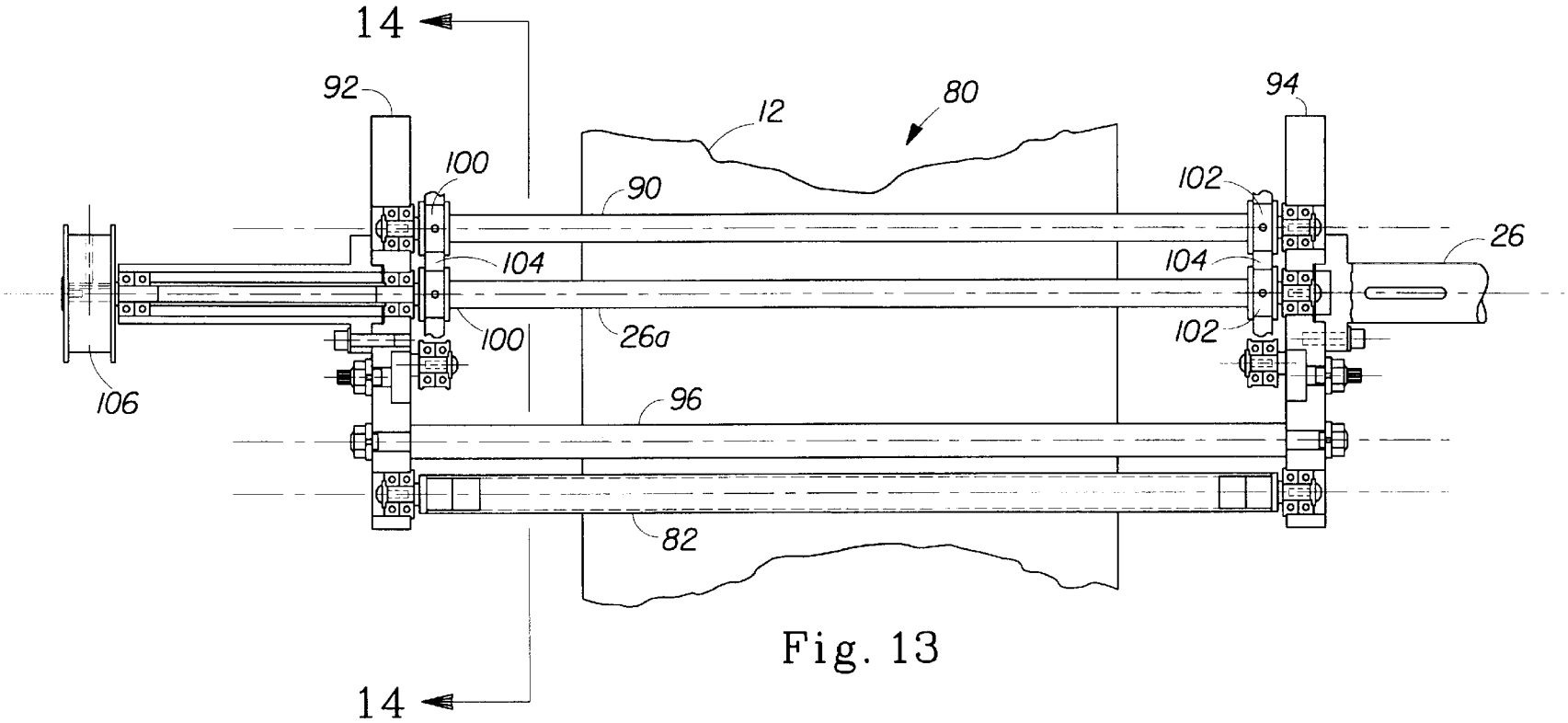
FIG. 13 is a cross-sectional view perpendicular to the machine axis illustrating the drive configuration of a web deflector in accordance with another embodiment of the present invention defined by a series of spaced parallel rolls.
Figure 14:
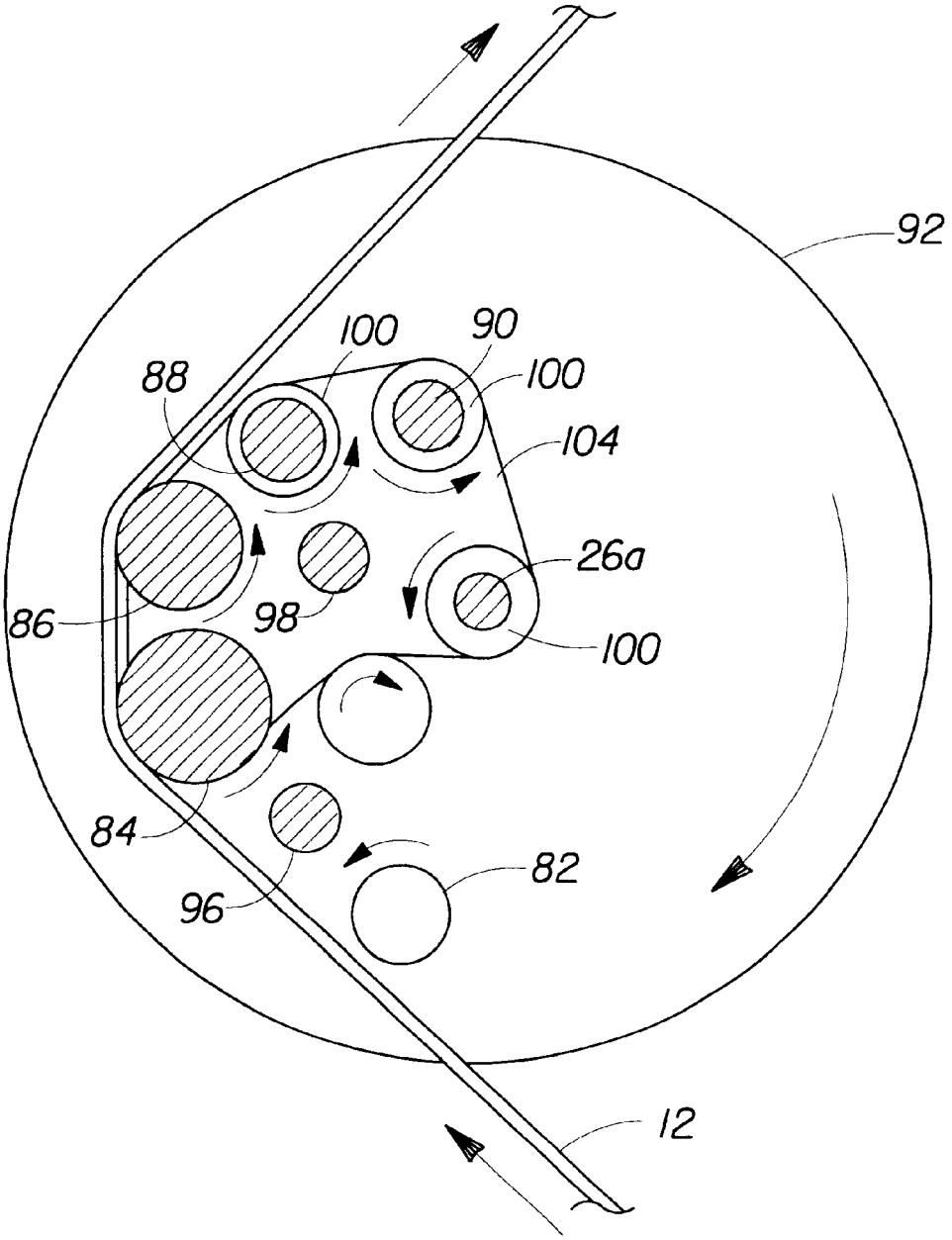
FIG. 14 is a view taken along the line 14—14 of FIG. 13 illustrating the drive configuration and the external peripheral configuration of a web deflector shown in FIG. 13.

As an alternative to the use of an endless moving belt to define the peripheral surface of the web deflector, a series of rotatable, elongated rollers can be provided. In that regard, the radially outermost peripheral edges of each of the rollers are respective points that define the cross-sectional shape of the periphery of web deflector 80 as shown in FIGS. 13 and 14. FIG. 13 is a view parallel to the machine axis taken through web deflector 80 that includes a plurality of rollers 82 through 90 that are each rotatably supported in bearings carried in a pair of spaced end housings 92, 94.

A pair of spaced, parallel support bars 96, 98 extend between end housings 92, 94 to interconnect them and to provide a supporting framework for the respective rollers. Within each of end housings 92, 94, driven rollers 84, 86, 88, and 90 each include respective end-mounted drive pulleys 100, 102 that are secured to the outermost ends of the respective rollers, each of the drive pulleys having a groove or recess to receive a drive belt 104. Belt 104 passes over the respective pulleys 100, 102 and is driven from pulleys 100, 102 carried on drive shaft 26*a* driven from a suitable power source (not shown) by a belt or the like that drives a main drive pulley 106. The sizes of the respective pulleys are selected to provide a driven roller peripheral speed that causes the respective driven rollers to rotate at speeds such that their respective surface speeds correspond substantially with the linear speed of movement of first web 12, thereby minimizing friction between the moving web and the deflector and avoiding undesired elongation of a delicate or easily extensible material web. And although shown and described as a belt drive, it will be apparent to those skilled in the art that other drive arrangement can also be utilized, such as a chain drive, a gear drive, or the like.

In addition to the belt approach shown in FIG. 12 and the driven roller approach shown in FIGS. 13 and 14, the friction between first web 12 and the surface of the web deflector can alternatively be minimized by providing a web deflector 108 that provides a peripheral air lubrication film, as shown in FIGS. 15 through 18. Deflector 108 can have a continuous outer peripheral surface 110 that is contacted by first web 12 and that includes a plurality of apertures 112 through which pressurized air can pass to form a thin film of air on outer surface 110 to minimize direct frictional contact between first web 12 and peripheral surface 110 of deflector 108.

Figure 15:
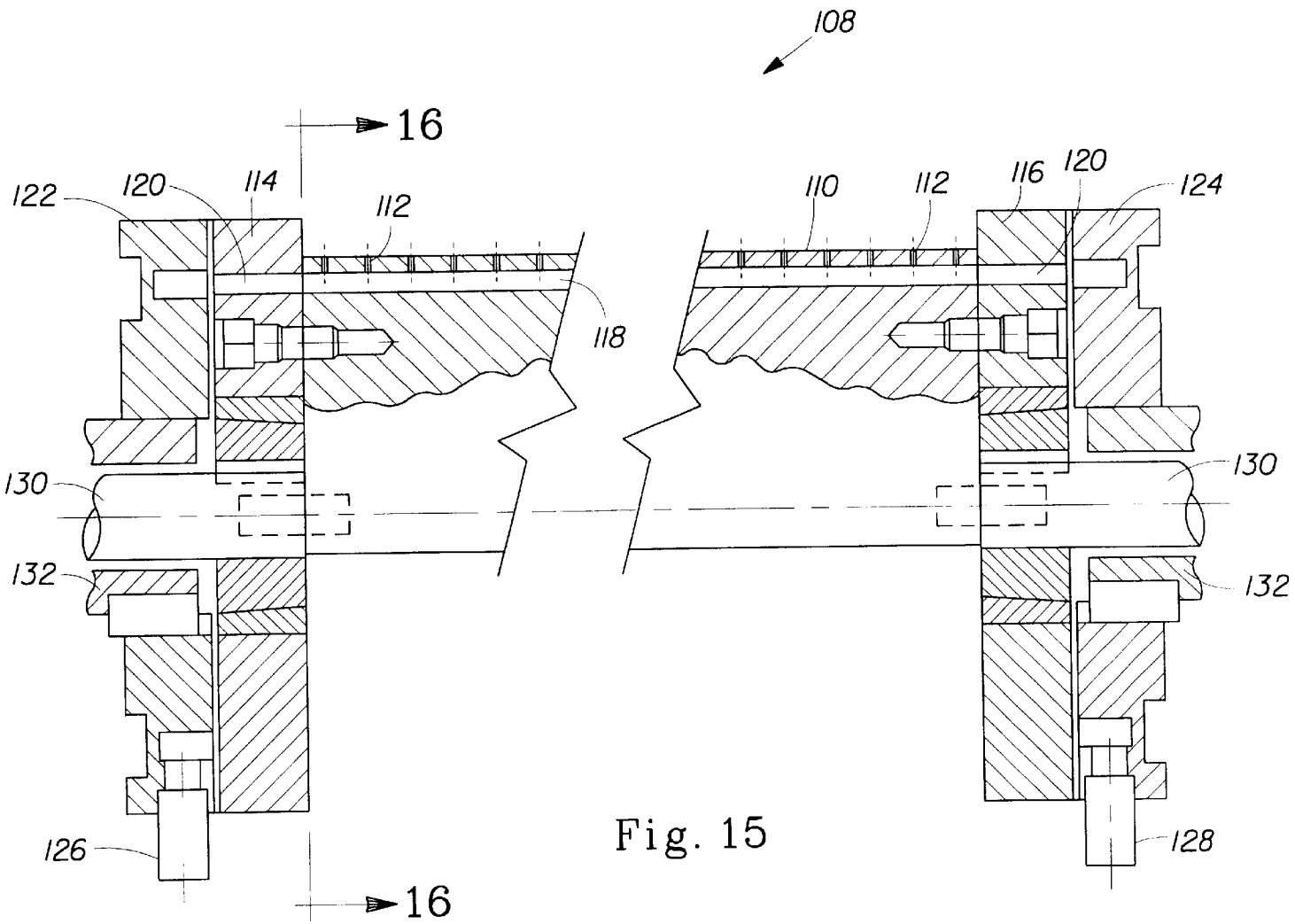
FIG. 15 is a cross-sectional view perpendicular to the machine axis of another embodiment of a web deflector in accordance with the present invention.
Figure 16:
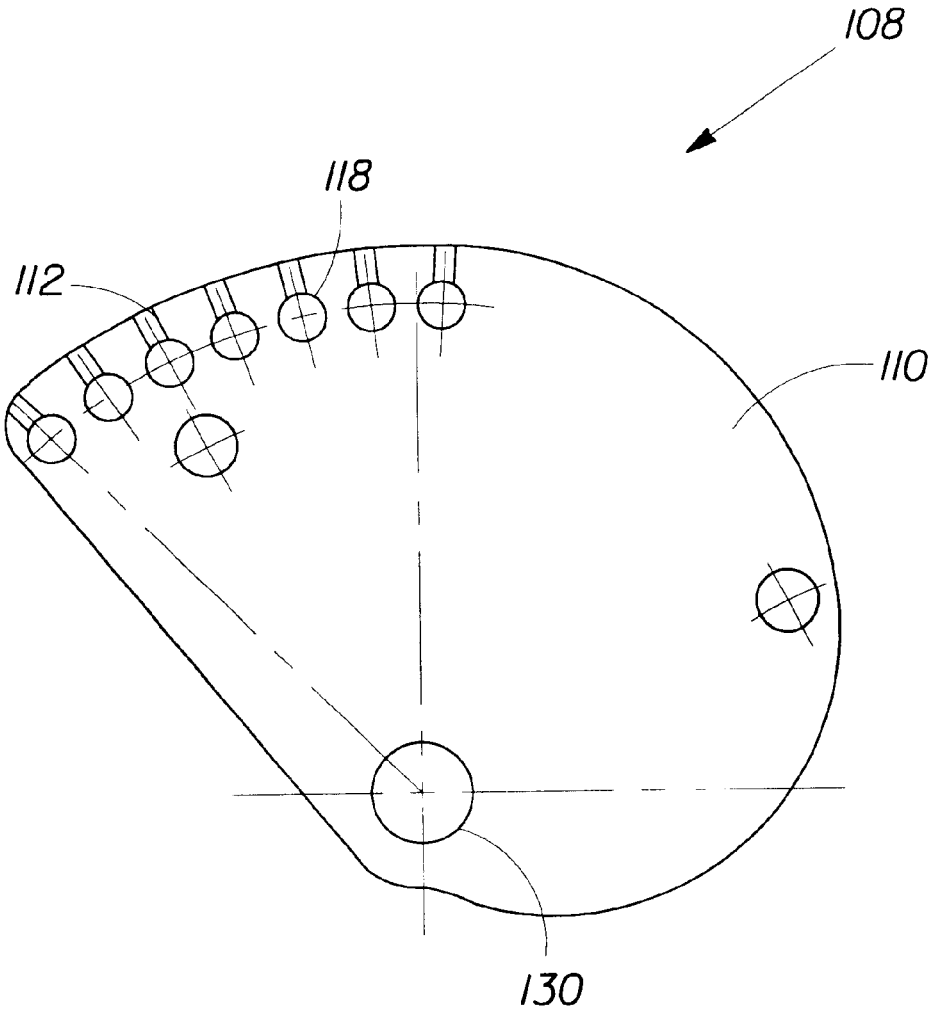
FIG. 16 is a cross-sectional view perpendicular to the machine axis taken along the line 16—16 of FIG. 15.
Figure 17:
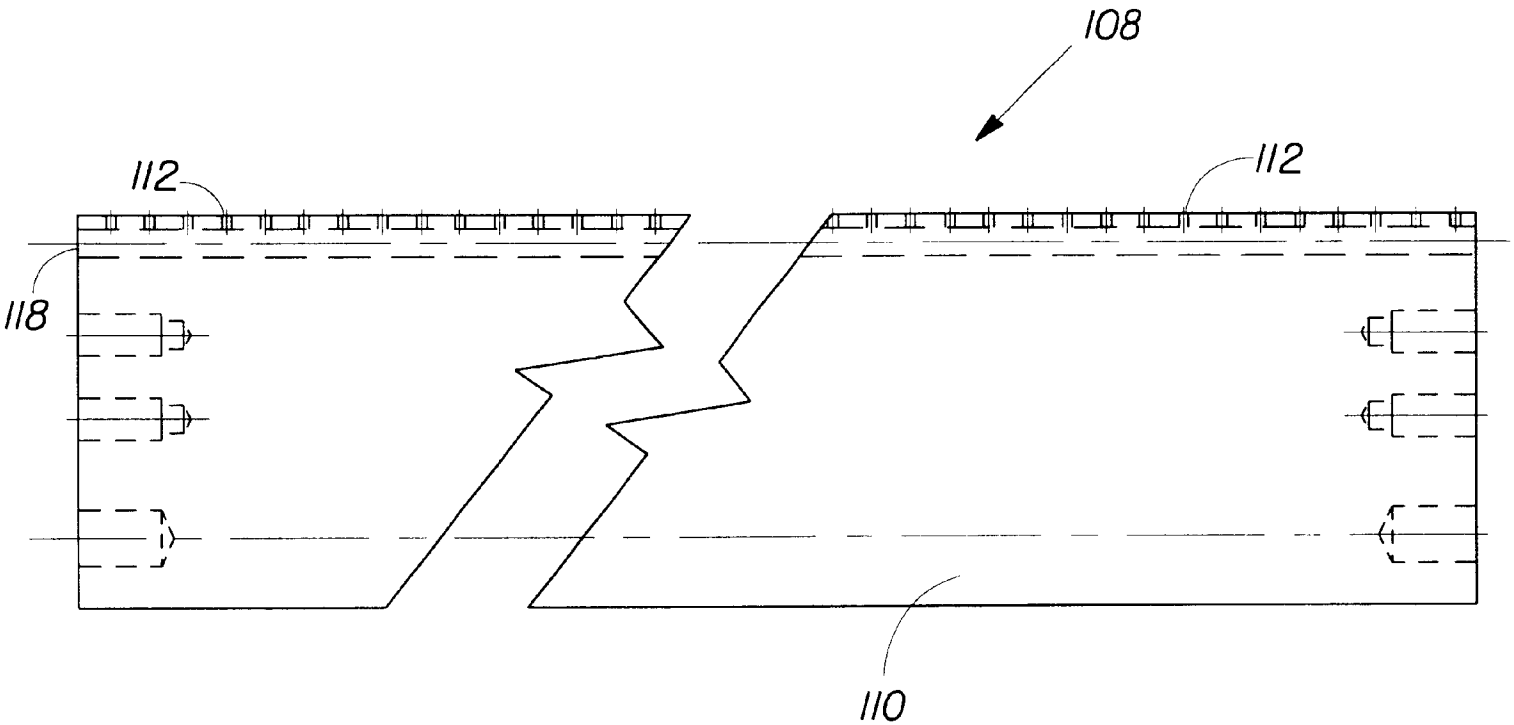
FIG. 17 is an elevational view of the web deflector shown in FIG. 16, taken perpendicular to the machine axis.

As best seen in FIG. 15, outer surface 110 of web deflector 108 is positioned between a pair of opposed end plates 114, 116. Deflector 108 includes a series of longitudinally-extending air distributor passageways 118 that communicate with one or more longitudinally-extending rows each including a plurality of apertures 112 that extend radially through peripheral surface 110 of deflector 108. End plates 114, 116 include a plurality of circularly-disposed, spaced openings 120 that communicate with respective ones of air distributors 118. Positioned adjacent end plates 114, 116 are a pair of air manifolds 122, 124 that communicate with a source of pressurized air (not shown) through respective air inlet conduits 126, 128. Web deflector 108 includes stub shafts 130 at each end that are rotatably carried in a respective end journal 132.

Pressurized air is provided to air manifolds 122, 124 and flows into passageways 118 within the interior of web deflector 108. The pressurized air exits through apertures 112 and thereby provides a peripheral air film that serves as an air bearing against which a fragile first web 12 can move to minimize friction between the web and the deflector surface and to minimize possible undesirable elongation of the low modulus first web material.

Although particular embodiments of the present invention have been illustrated and described, it would be apparent to those skilled in the art that various changes and modifications can be made without departing from the spirit of the present invention. It is therefore intended to be encompassed within the appended claims all such changes and modifications that fall within the scope of the present invention.

What is claimed is:

1. Web speed metering apparatus for receiving and engaging a web that is supplied to the metering apparatus at a constant infeed speed and for cyclically varying the output speed of the web leaving the metering apparatus, said web speed metering apparatus comprising:

a) a rotatable shaft defining an axis of rotation that is disposed across a path of movement of a moving web of material to be metered;

b) a web-engaging surface carried by the shaft and extending axially thereof, the web-engaging surface adapted to receive the web and defining a non-circular cross section, the cross section having a centroid that is offset from the axis of rotation to cause the speed of the web downstream of the metering apparatus to vary as a function of the instantaneous radial spacing of the web from the axis of rotation of the web-engaging surface, wherein the web-engaging surface includes a first matched speed zone within which the output speed of the web as it leaves the web speed metering apparatus is at a speed that is substantially equal to a surface speed of a downstream web-receiving element; a web storage zone within which the output speed of the web as it leaves the web speed metering apparatus is progressively reduced from the matched speed to a predetermined web output speed value; a second matched speed zone within which the output speed of the web as it leaves the web speed metering apparatus is at a speed that is substantially equal to the web infeed speed; and a null zone between the first and second matched speed zones and within which the output speed of the web is less than the matched speed and within which the leading edge of the web advances a predetermined distance along a moving surface of the downstream web-receiving device.

2. Web speed metering apparatus in accordance with claim 1, wherein the downstream web-receiving device is a cutting station for cutting sections from the web.

3. Web speed metering apparatus in accordance with claim 2, wherein the cutting station executes cuts that extend at an acute angle relative to the web movement direction.

4. Web speed metering apparatus for receiving and engaging a web that is supplied to the metering apparatus at a constant infeed speed and for cyclically varying the output speed of the web leaving the metering apparatus said web speed metering apparatus comprising:

a) a rotatable shaft defining an axis of rotation that is disposed across a path of movement of a moving web of material to be metered;

b) a web-engaging surface carried by the shaft and extending axially thereof, the web-engaging surface adapted to receive the web and defining a non-circular crass section, the cross section having a centroid that is offset from the axis of rotation to cause the speed of the web downstream of the metering apparatus to vary as a function of the instantaneous radial spacing of the web from the axis of rotation of the web-engaging surface, wherein the web-engaging surface in a direction perpendicular to the axis of rotation is defined by a plurality of convexly-curved arcs and at least one rectilinear section, wherein the cross section of the web-engaging surface is defined by a first circular arc having a first radius of curvature with its center coincident with the axis of rotation; a second circular arc having a second radius of curvature with its center coincident with the axis of rotation and spaced angularly, relative to the axis of rotation, from the first circular arc; a rectilinear intermediate section extending between one pair of angularly-spaced ends of the first and second circular arcs; and a curvilinear intermediate section extending between a second pair of angular-spaced ends of the first and second circular arcs.

5. Web speed metering apparatus in accordance with claim 4, wherein the first radius of curvature is smaller than the second radius of curvature.

6. Web speed metering apparatus in accordance with claim 4, wherein the curvilinear intermediate section is defined by a curve of varying radius that varies progressively from the first radius of curvature to the second radius of curvature.

7. Web speed metering apparatus in accordance with claim 4, wherein the first circular arc subtends a first included angle relative to the axis of rotation and the second arc subtends a second included angle relative to the axis of rotation.

8. Web speed metering apparatus in accordance with claim 7, wherein the first and second included angles are substantially equal.

9. Web speed metering apparatus in accordance with claim 7, wherein the second included angle is greater than the first included angle.

10. Web speed metering apparatus in accordance with claim 7, wherein the included angles range from about 2° to about 35°.

11. Web speed metering apparatus in accordance with claim 10, wherein an included angle subtended by the rectilinear intermediate section ranges from about 45° to about 87°.

12. Web speed metering apparatus in accordance with claim 11, wherein an included angle subtended by the curvilinear intermediate section ranges from about 30° to about 220°.

13. Web speed metering apparatus in accordance with claim 4, wherein the web-engaging surface is defined by a continuous peripheral surface that extends both axially and circumferentialty relative to the axis of rotation.

14. Web speed metering apparatus in accordance with claim 13, wherein the continuous peripheral surface is an endless belt.

15. Web speed metering apparatus in accordance with claim 14, wherein the belt is movable about the axis of rotation.

16. Web speed metering apparatus in accordance with claim 13, wherein the continuous peripheral surface includes a plurality of apertures for communication with a source of air under pressure.

17. Web speed metering apparatus in accordance with claim 16, wherein the continuous peripheral surface includes a constant radius section.

18. Web speed metering apparatus in accordance with claim 17, wherein the apertures are provided in the constant radius section.

19. Web speed metering apparatus in accordance with claim 4, wherein the web-engaging surface is defined by a plurality of interconnected, discrete peripheral surfaces that extend axially relative to the axis of rotation.

20. Web speed metering apparatus in accordance with claim 19, wherein the peripheral surfaces are defined by radially outermost surfaces of a plurality of rotatable rollers that have their axes disposed parallel to the axis of rotation and that are spaced from each other in a radial direction relative to the axis of rotation and in a circumferential direction relative to the axis of rotation.

21. Web speed metering apparatus in accordance with claim 20, wherein the rotatable rollers are positively driven to rotate in the same direction so that the roller surface velocity is directed in the same direction as the direction of movement of the web.

22. Web speed metering apparatus in accordance with claim 21, wherein the rotatable rollers are driven by a belt drive system.

* * * * *

UNITED STATES PATENT AND TRADEMARK OFFICE

CERTIFICATE OF CORRECTION

PATENT NO. : 6,763,749 B2
DATED : July 20, 2004
INVENTOR(S) : John F. Droste et al.

It is certified that error appears in the above-identified patent and that said Letters Patent is hereby corrected as shown below:

Column 5,
Line 9, delete “seccond” and insert -- second --.

Column 11,
Line 7, delete “crass” and insert -- cross --.

Signed and Sealed this

Seventh Day of February, 2006

JON W. DUDAS
*Director of the United States Patent and Trademark Office*